United States Patent [19]

Benner, Jr. et al.

[11] Patent Number: 4,702,289

[45] Date of Patent: Oct. 27, 1987

[54] VOLUMETRIC FILLER FOR POUCH MACHINE

[75] Inventors: Harold T. Benner, Jr.; Mark A. Leonhardt, both of Cincinnati, Ohio; Matthew J. Zdinak, Erlanger, Ky.

[73] Assignee: R. A. Jones & Co. Inc., Convington, Ky.

[21] Appl. No.: 880,066

[22] Filed: Jun. 30, 1986

[51] Int. Cl.[4] ..... B65B 3/04

[52] U.S. Cl. ..... 141/125; 141/71; 53/562

[58] Field of Search ..... 141/125, 129–192, 141/69–82; 53/562

[56] References Cited

U.S. PATENT DOCUMENTS 2,602,579 7/1952 Carruthers ..... 141/125

*Primary Examiner*—Houston S. Bell, Jr.

*Attorney, Agent, or Firm*—Wood, Herron & Evans

[57] ABSTRACT

A web of pouches is carried around a rotating drum. Above the drum is a filler. The filler has a lower stationary plate with an arcuate slot in it. Above the stationary plate are two rotating plates which are vertically-spaced apart. The plates have aligned holes forming cups. A hopper is located above the rotating plates to pour product onto the rotating plates. A separator is located between the rotating plates and overlies the slot in the stationary plate whereby the lower primary cups are filled through the upper secondary cups and are discharged into pouches through the slot in the stationary plate while the separator holds back the product in the upper secondary cups.

6 Claims, 7 Drawing Figures

VOLUMETRIC FILLER FOR POUCH MACHINE

This invention relates to volumertric filling apparatus for a continuous motion pouch form, fill, seal machine.

The continuous motion pouch form, fill, seal machine includes apparatus for folding a continuous web upon itself. The web is passed around a drum having vertical sealing lands to separate the web into a continuous series of pouches. The web is then passed around a drum where the pouches are opened for the filling operation. Above the drum is a filling mechanism that will be described. After filling, the pouches are conveyed away from the drum through a sealer which closes the tops of the pouches and a cutting apparatus which separates the web into individual filled pouches.

Until the present invention, the filler has consisted of a stationary plate mounted above the drum which carries the pouches. The stationary plate has an arcuate slot overlying the path of the pouches. Above the stationary plate is a rotating plate having a plurality of uniformly-spaced holes lying in a circle around the rotating plate, the circle passing over the arcuate slot in the stationary plate. A hopper above the rotating plate continuously feeds product onto the rotating plate. Gates and scrapers of varying configurations depending upon the product being filled overlie the rotating plate to scrape away excess product from the individual cups. When the cups have been filled and scraped to the desired amount, the cups pass over the slot in the stationary plate and discharge their contents through the slot and into the pouches below, via funnels which are carried above the pouches.

The operation of the pouch machine takes place at a very high speed as, for example, 500–600 pouches per minute. At this speed, the challenge is to introduce into each cup a uniform volume of product. In general, the manufacturer of the product who packages the product in a pouch machine sells the product by weight, but packages it by volume. In order to obtain uniform weight in the pouch, the volume in each cup must be uniformly maintained. It is, of course, impossible to achieve perfection in the filling of the cups. For example, coffee is relatively easy to handle. The filling operation for it is maintained at a weight variation of plus or minus about 1%.

At the upper end of the scale of difficulty is the dehydrated noodle soup packaging operation. The noodles tend to interlock with each other and form bridges as they are discharged form the hopper onto the rotating plate. Any system of scrapers tending to level off the noodle product in the cups of the rotating plate will also tend to pull noodles out of the cups to a greater or lesser extent. Thus, in the conventional pouch-filling apparatus of the type described, it is difficult to achieve better than about a 15–17% variation.

It has been possible to cut that variation to about 8% on an intermittent motion pouch machine. In that machine, at a filling station, the product descends by gravity through a tube to a filling cup. Between the tube and the filling cup is a reciprocating knife which cuts through the product between the tube and the cup, thereby permitting the product to drop from the cup to the pouch while the product in the tube is held back by the reciprocating knife. That intermittent motion operation is slow, the machine producing between about 60 to 100 pouches per minute.

Reduction in the percentage variation is of course extremely important to the producer of the product. That company, in order to assure the customer of getting the maximum amount specified on the package, must overfill by the amount of the variation. Thus, the minimizing of the variation reduces the amount of overfill which the producer is required to load into the pouches and results in a considerable saving to the manufacturer.

An objective of the present invention has been to improve the continuous motion volumetric filling apparatus. More specifically, in the filling of hard-to-handle products such as noodle soups, the apparatus of the present invention has reduced the variation from plus or minus 15–17% to plus or minus 6–7% without exceeding an unacceptable amount of breakage.

The objective of the invention is attained by providing, above the stationary slotted plate, a pair of rotating plates; a primary rotating plate below and a secondary rotating plate above. The primary rotating plate has a plurality of holes spaced around a circle and forming primary cups. The secondary plate has a plurality of aligned secondary holes aligned above the primary cups and forming secondary cups. A stationary hopper is provided to continuously supply product to the stationary plate. Plows smooth the product out somewhat as it fills the primary and secondary cups. It is not necessary to level the product off on top of the secondary cups.

A stationary separator is interposed between the two plates above the slot in the stationary plate below. The function of the separator is to hold back product in the secondary cups while the product in the primary cups, thus sliced off by the separator is discharged through the arcuate slot into the pouches below. Preferably, the leading edge of the separator is a V-shaped knife edge. Still further, it is preferable to have a second knife edge upstream of the knife edge associated with the separator to make a first cut through the product between the secondary and primary cups. The first cut tends to break up bridges which have been formed and permit a more uniform settling of product into the primary cups below the secondary cups before that product is discharged into the pouches.

Another feature of the invention is that it admits of the possibility of controlling the head above the primary cups, that is, the volume and hence weight of the product above the primary cup. This control produces greater uniformity or less variance in the product introduced into the respective pouches.

The several features and objectives of the present invention will become more readily apparent from the following detailed description taken in conjunction with the accompanying drawings in which.

Figure 1:
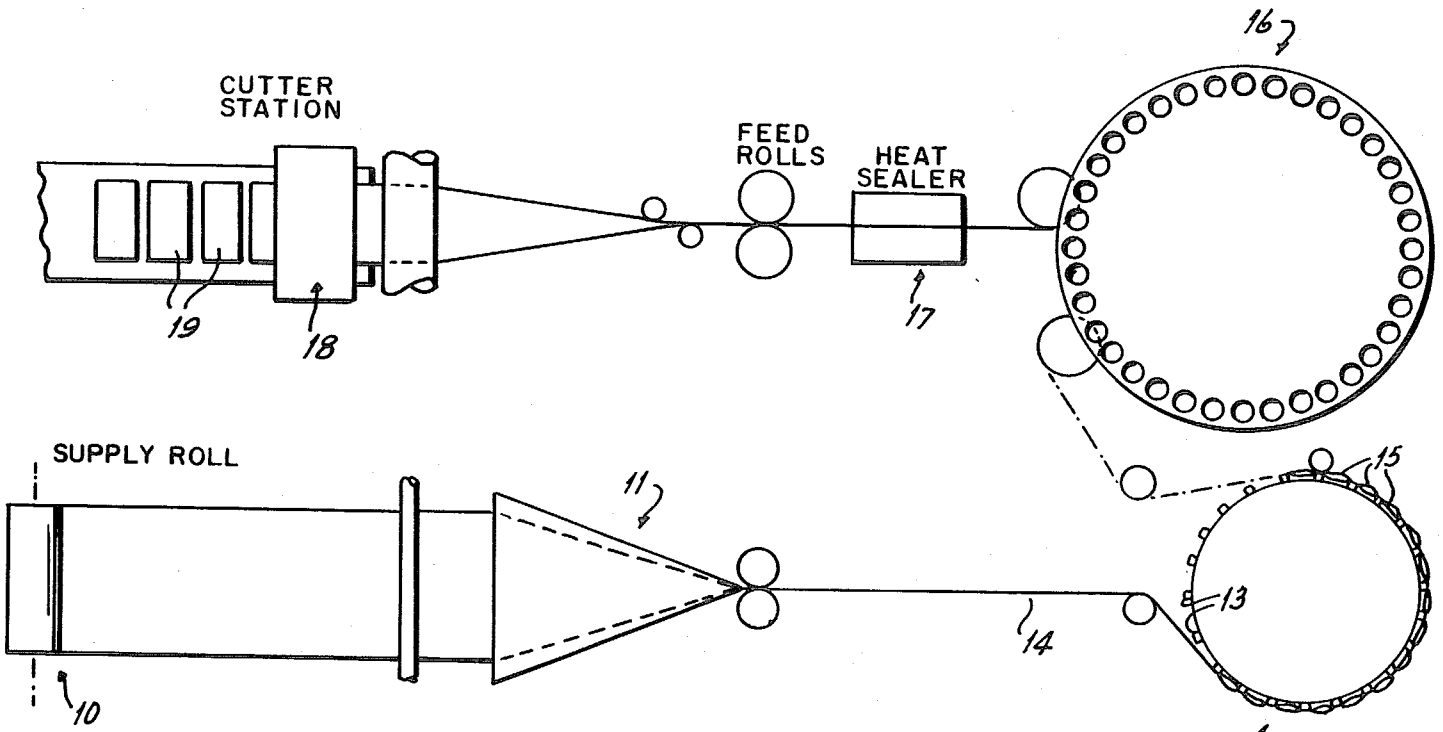
FIG. 1 is a diagrammatic plan view of a pouch form, fill, seal machine to which the present invention is applied.

A pouch form, fill, seal machine of the type to which the present invention is directed is shown in FIG. 1. A supply roll of film or foil is shown at 10. It passes over a plow 11 where it is folded upon itself. The thus-folded film is passed around a vertical sealer 12 which is a drum having a plurality of vertical lands 13 which apply vertical seals to the folded web 14, thereby forming individual pouches 15. The web is then passed around a filling station 16 which is provided with means for opening the pouches to permit them to be filled. Above the pouches is a filling mechanism which will be described in detail hereafter which discharges measured volumes of product into the individual pouches while they are in web form.

After being filled at the filling station 16, the web is passed through a heat sealer 17 which forms a seal across the open ends of the pouches in the webs. Thereafter, the web is turned to a horizontal attitude and passed through cutting knives 18 to cut the web into individual pouches 19. The mechanism as thus far described is old and can be more fully understood by reference to U.S. Pat. No. 3,597,898, for example.

Figure 2:
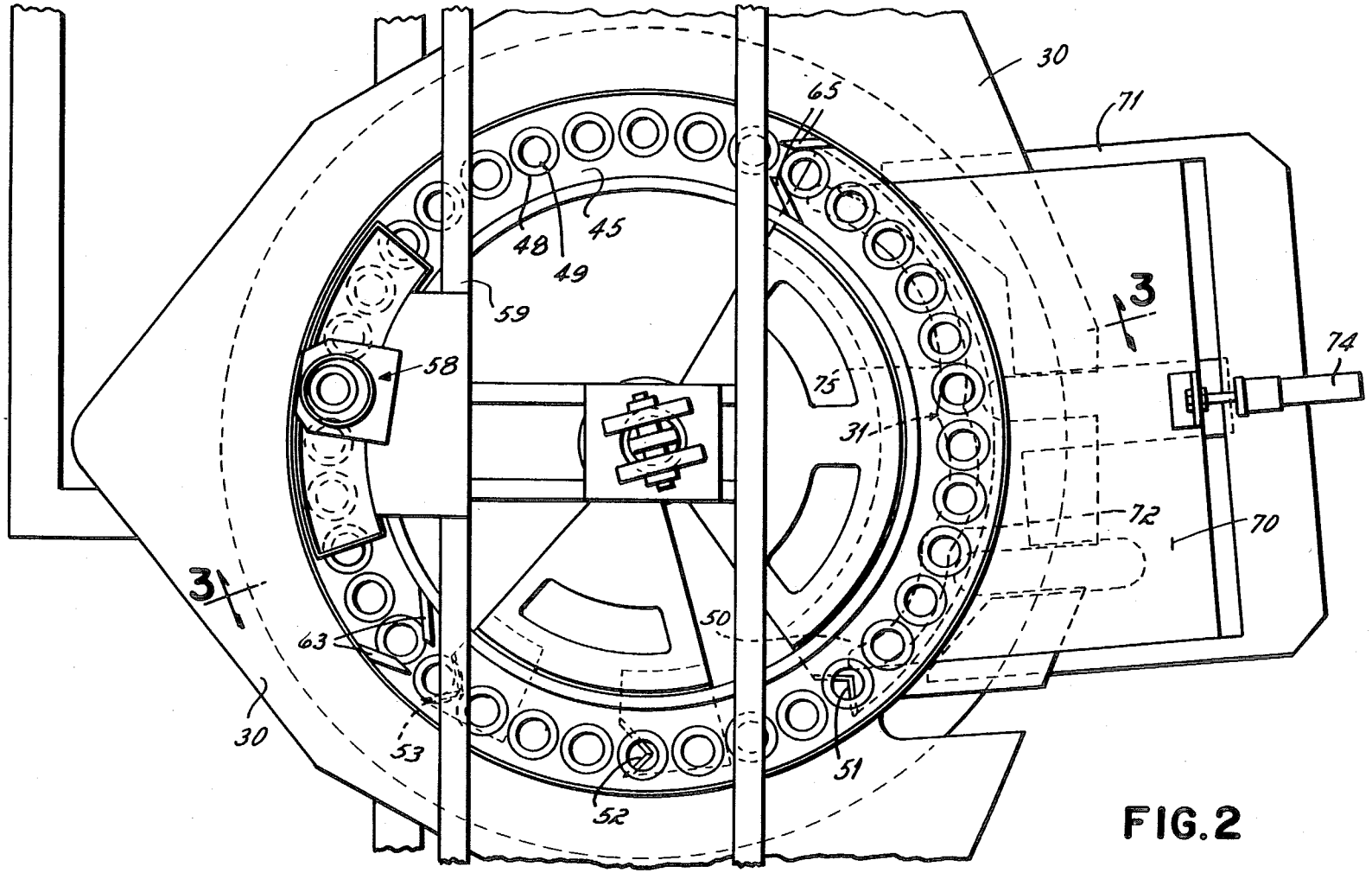
FIG. 2 is a plan view of the filler mechanism of the present invention.
Figure 3:
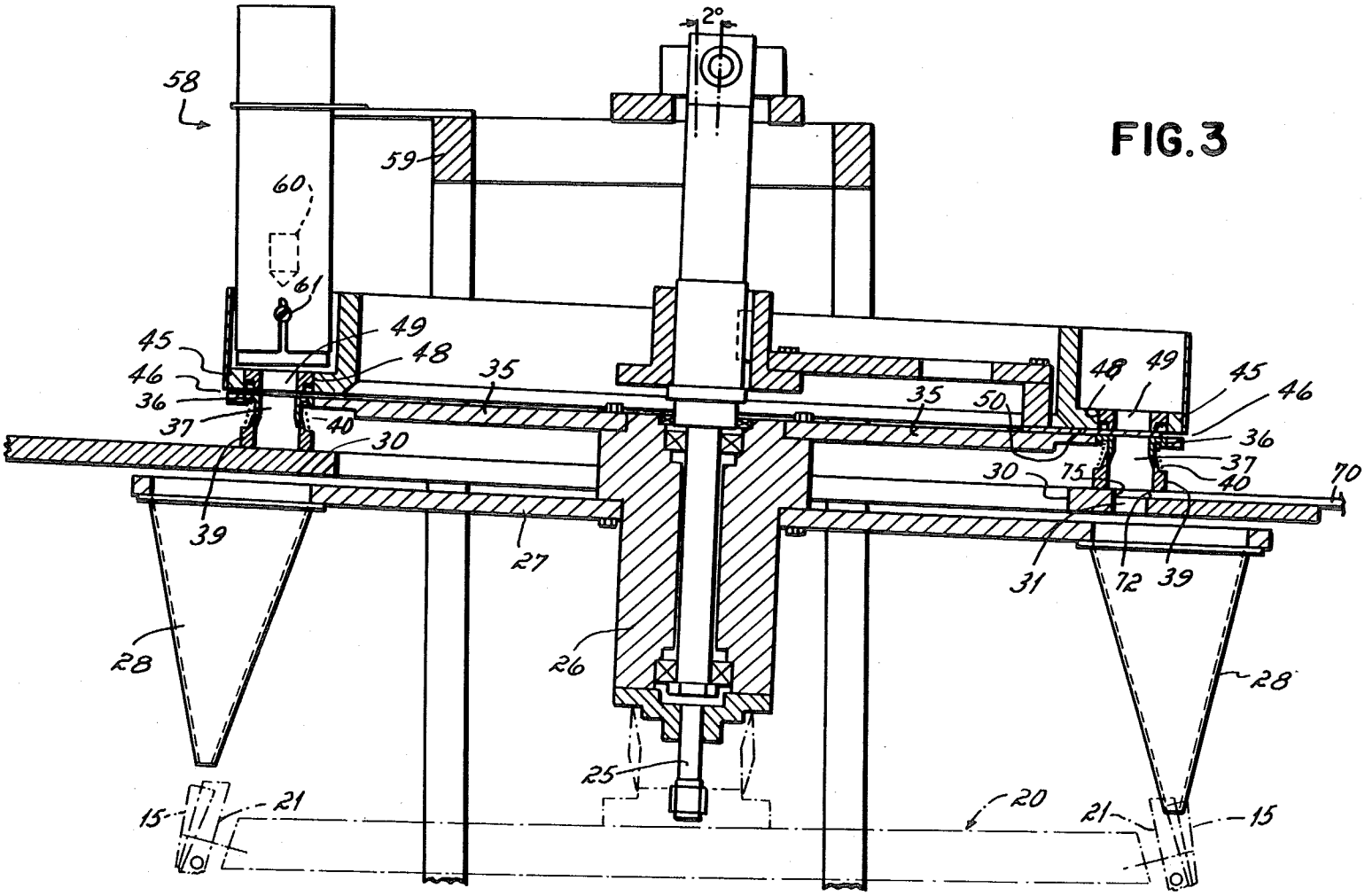
FIG. 3 is a cross-sectional view taken along lines 3—3 of FIG. 2.

As stated, the present invention is directed to the filling apparatus. This is shown in FIGS. 2 and 3. As shown in FIG. 3, a rotating drum 20 is provided and has lands 21 which receive pouches 15 in the web 14. The drum drives a shaft 25 which is slightly inclined to the axis of the drum. The shaft drives a sleeve 26 to which is mounted a rotary funnel plate 27. The funnel plate has a plurality of funnels 28, one funnel being disposed between each pair of lands which support a pouch 15. At one side of the plate 27, the funnels are spaced above the pouches. At the other side of the plate, the right side as viewed in FIG. 3, the funnels have descended into the pouches because of the 2° angle of inclination of the axis of the shaft 25 to the axis of the drum 20.

Above the funnel plate is a stationary plate 30 having an arcuate slot 31 therein. The plate serves as a trap door permitting the discharge of product into the funnels, as will appear below.

The sleeve 26 carries a primary plate 35 which rotates with respect to the stationary plate 30. The primary plate has a plurality of holes 36 forming cups 37 which are uniformly and circumferentially spaced around the circumference of the plate 35. Each cup is aligned with a respective funnel 28 and rotates with that funnel. The circle about which the cups are spaced is on the same radius as the arcuate slot 31 of the stationary plate so that the cups pass over the arcuate slot. Each cup has a slidable cuff 39 which is urged by a spring 40 into engagement with the stationary plate. Thus, each cup 37 rides in continuous contact with the stationary plate so that product which is disposed in the cup 37 cannot escape the cup until the cup rides over the arcuate slot 31.

A secondary plate 45 is spaced above the plate 35 leaving a gap 46 between the two plates. The secondary plate has a plurality of holes 48 forming secondary cups 49. The cups are uniformly-spaced about the circumference of the plate 45 with one cup in the secondary plate being vertically-aligned with each cup of the primary plate. The ratio of the volumes of the secondary cup to the primary cup may be varied in the range of 1:1 to 4:1, for example, depending upon the product. Between the two plates 35 and 45 is a thin separator 50. Preferably, the leading edge of the separator is in the shape of a V-shape knife edge 51, as shown in FIG. 2. The separator overlies the entire arcuate slot 31 so as to hold back product in secondary cups 49 while the primary cups 37 are discharging their product through their funnels and into the pouches. One or more knives 52, 53 may be spaced upstream of the separator 50 to break up bridges of noodles and the like between the upper and lower cups, thereby to encourage greater uniformity of the filling of the primary cups.

A hopper 58 is mounted on a frame member 59 and overlies the secondary plate 45. A vertical element 60 may be positioned in the center of the hopper to assist in the breaking up of a bridging tendency of the product, thereby encouraging free flow of product from the hopper to the secondary plate 45. The hopper is arranged to be spaced above the secondary plate and has a set screw adjustment 61 for varying the vertical position of agate in the hopper above the secondary plate 45. Immediately downstream of the hopper are a pair of stationary scrapers 63 which engage the product dropping onto the secondary plate and encourage it to flow into the secondary cups 49 and thence to the primary cups 37. An additional set of scrapers 65 may be employed just downstream of the arcuate slot 31 to wipe product into the secondary cups and thence into the primary cups which have just discharged through the arcuate slot 31 into the pouches.

The width of the arcuate slot 31 may be changed. To this end, the arcuate slot is formed in part by a plate 70 which is slidable in a frame 71. The plate has an edge 72 forming one edge of the slot 31. A piston and cylinder 74 is connected to the plate and is provided to slide the plate toward or away from the opposed edge 75 to vary the width of the slot 31 or to close the slot altogether.

Figure 4:
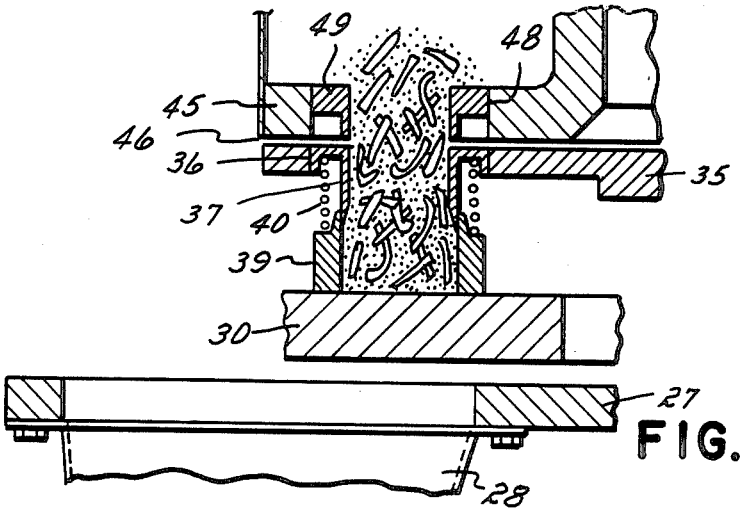
FIGS. 4–7 are diagrammatic cross-sectional views illustrating the cooperative action of the primary and secondary cups to perform the filling operation.
Figure 5:
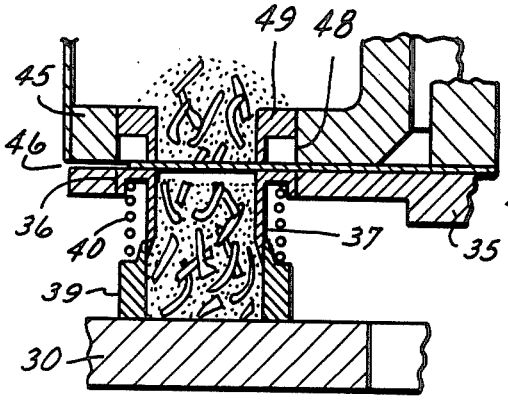
Figure 6:
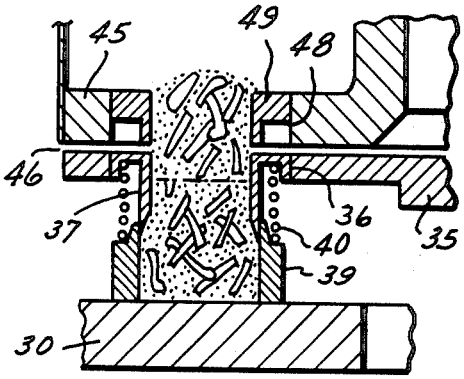
Figure 7:
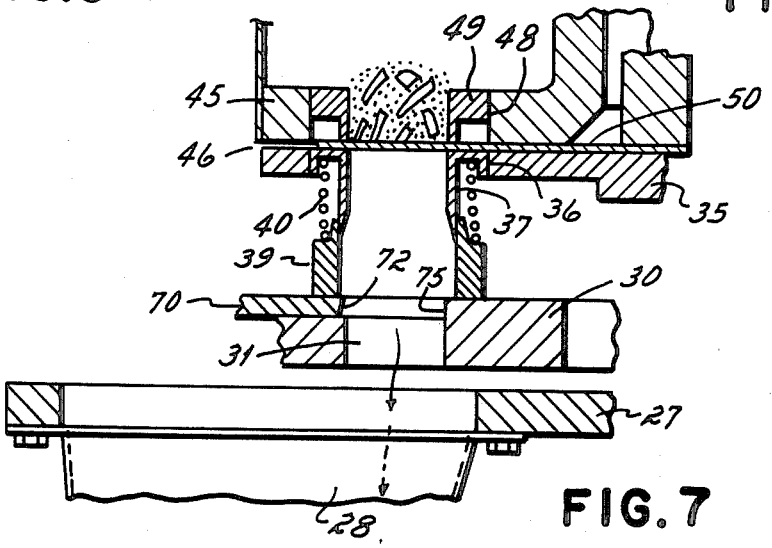

The operation of the invention may be best understood by referring additionally to FIGS. 4-7. The rotating plates as well as the funnels and drum are rotated at a speed which will produce 500 or more pouches per minute. Product is deposited into hopper 58 in such a way as to keep it continuously filled. The hopper is spaced above the plate 45 so as to deposit a predetermined amount onto the plate 45. The plate 45 carries the just deposited product past the scraper 63. The scrapers 63 funnel product into the secondary cups which pass underneath the plows, the product flowing from the secondary cups into the primary cups as illustrated in FIG. 4. As the rotating plates carry the filled cups past the stationary knives 53, 52 and 51, the knives slice through the product and cause it to settle uniformly into the primary cups. See FIGS. 5 and 6 to show the effect of the knives cutting through the product. As the primary and secondary cups reach the separator 50, as shown in FIG. 7, each primary cup 37 begins to ride over the arcuate slot 31. The product in the primary cup therefore discharges through the slot 31 into the respective funnel 28 and thence into the pouch below. In the meantime, the product in the secondary cup 49 is restrained from flowing out of the secondary cup into the primary up by the separator 50. After the cups pass the slot 31, the separator 50 is discontinued, whereupon communication between the secondary and primary cups is resumed. At this time, all of the product in the secondary cups will flow down into the primary cups below. Excess product which might be lying on top of the secondary plate 45 will be wiped the plows 65 into the secondary cups. Thus, the product has approximately 270° of rotation of the primary and secondary plates to settle, by the vibration of the apparatus into the primary cups, that is, the product settles from the point that the cups leave the separator 50 until the cups reach the leading knife edge of the separator 50.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

Having described our invention, we claim:

1. A volumetric cup filler comprising:

a first rotating plate, means forming a plurality of uniform volume primary cups spaced in a circle around said plate, means covering the bottom of said primary cups, a second rotating plate spaced above said first plate, a plurality of secondary cups in said second plate, each secondary cup being aligned above a respective primary cup, stationary means above said rotating plates for feeding product into said secondary cups to fill said primary cups and at least partially fill said secondary cups, at least one stationary knife and separator between said plates and spaced downstream from said feeding means, and means for removing said covering means after said knife slices through the product in said cups and said separator holds back the product in said secondary cup.

2. In a pouch filling machine including a large rotating drum about which a web of pouches is passed to be filled by a filler above said drum as said drum rotates under said filler, said pouch filler comprising:

a stationary plate having a discharge slot therethrough extending through an arc of a circle, a rotating primary plate connected to said drum and located immediately above said stationary plate, said rotating plate having a plurality of primary holes therethrough to form primary filling cups, said primary cups being uniformly-spaced about a circle that passes over said arcuate slot, a rotating secondary plate spaced above said primary plate and having a plurality of secondary cups aligned above said primary cups, a stationary hopper above said rotating plates for discharging product onto said secondary plate where it can be plowed into said secondary and primary cups, at least one stationary separator between said rotating plates and located above said arcuate slot to hold back product in said secondary cups while product is discharging from said primary cups through said slot into pouches.

3. A pouch filler as in claim 2 further comprising:

at least one stationary knife between said separator and said hopper to slice through product bridging the primary and secondary cups.

4. A pouch filler as in claim 2 further comprising:

at least two stationary knives between said separator and said hopper to slice through product bridging said primary and secondary cups, said knives being circumferentially spaced from each other, the upstream knife making an initial cut through product bridging said cups to provide greater settling action and uniformity of weight of product in said primary cups.

5. A pouch filler as in claim 2 further comprising:

scrapers overlying said secondary plate and located downstream of said slot in said stationary plate, said scrapers wiping product into said secondary cups immediately after the product from said primary cups has discharged into pouches.

6. A pouch filler as in claim 2 further comprising:

scrapers overlying said secondary plate and located immediately downstream of said hopper to funnel product into said secondary cups.

* * * * *